US008573019B2

(12) United States Patent
Steinhilber et al.

(10) Patent No.: US 8,573,019 B2
(45) Date of Patent: Nov. 5, 2013

(54) METHOD AND APPARATUS FOR THE PRODUCTION OF A BENT PART

(75) Inventors: Werner Steinhilber, Moessingen (DE); Stefan Fries, Reutlingen (DE); Anton Schoenle, Bad Saulgau (DE); Matthias Groeninger, Aichtal (DE)

(73) Assignee: WAFIOS AG (DE)

( * ) Notice: Subject to any disclaimer, the term of this patent is extended or adjusted under 35 U.S.C. 154(b) by 463 days.

(21) Appl. No.: 12/900,641

(22) Filed: Oct. 8, 2010

(65) Prior Publication Data

US 2011/0192204 A1 Aug. 11, 2011

(30) Foreign Application Priority Data

Feb. 8, 2010 (DE) ..... 10 2010 007 888

(51) Int. Cl.
*B21D 11/00* (2006.01)
*G06F 19/00* (2011.01)

(52) U.S. Cl.
USPC ..... 72/307; 72/308; 72/388; 700/165

(58) Field of Classification Search
USPC ..... 72/17.3, 215–217, 306–311, 319, 387, 72/388
See application file for complete search history.

(56) References Cited

U.S. PATENT DOCUMENTS

| | | | | |
|---|---|---|---|---|
| 3,850,308 | A | 11/1974 | Meyer et al. | |
| 4,627,255 | A * | 12/1986 | Archer et al. | 72/17.3 |
| 2005/0076694 | A1 * | 4/2005 | Latour | 72/307 |

FOREIGN PATENT DOCUMENTS

| | | | |
|---|---|---|---|
| DE | 2022745 | | 11/1971 |
| DE | 4110313 | | 9/1992 |
| DE | 69510898 | | 12/1996 |
| DE | 19907989 | | 10/1999 |
| DE | 198 30 962 | A1 | 1/2000 |
| DE | 198 35 190 | A1 | 2/2000 |
| DE | 69700915 | | 7/2000 |
| DE | 10106741 | | 10/2002 |
| EP | 1326798 | | 4/2006 |
| EP | 1834920 | | 9/2007 |
| JP | 2009-214160 | A | 9/2009 |
| WO | 2007/095945 | | 8/2007 |

* cited by examiner

*Primary Examiner* — Debra Sullivan
(74) *Attorney, Agent, or Firm* — DLA Piper LLP (US)

(57) ABSTRACT

A method produces a bent part by two- or three-dimensional bending of an elongate workpiece, in particular a wire or tube, in a bending process wherein at least one portion of the workpiece is moved into an initial position in the region of engagement of a bending tool by one or more feed operations by the coordinated activation of the movements of driven machine axes of a bending machine numerically controlled by a control device and is formed by bending in at least one bending operation with the aid of a bending tool. The movements of the driven machine axes are generated according to a movement profile predeterminable by the control device of the bending machine and include at least one oscillation-relevant movement leading to an oscillation of the free end portion of the bent part. During an oscillation-relevant movement, a compensating movement, reducing the generation of oscillation and/or damping the oscillation, a machine axis is generated in at least one compensation time interval.

23 Claims, 7 Drawing Sheets

METHOD AND APPARATUS FOR THE PRODUCTION OF A BENT PART

RELATED APPLICATION

This applications claims priority of German Patent Application No. 10 2010 007 888.3, filed on Feb. 8, 2010, the subject matter of which is incorporated herein by reference.

TECHNICAL FIELD

This disclosure relates to methods for the production of bent parts by two- or three-dimensional bending of an elongate workpiece, in particular a wire or a tube, and also to an apparatus, suitable for carrying out the method.

BACKGROUND

In the automated production of two- or multi-dimensionally bent parts with the aid of numerically controlled bending machines, the movements of machine axes in a bending machine are activated in a coordinated manner with the aid of a control device to generate one or more permanent bends on the workpiece, for example, a wire, tube, conduit or bar, by plastic forming. In a bending process, in this case, at least one portion of the workpiece is moved into an initial position in the engagement region of a bending tool by one or more feed operations, such as drawing in, positioning and/or orientation, and is formed in at least one bending operation with the aid of the bending tool.

When a bend is made in a bending operation, the free end of the bent part, which, where appropriate, is already bent once or more than once, is led around part of the bending tool, for example, a stationary bending mandrel. Particularly during the bending operation, but, where appropriate, also during the positioning of the workpiece and/or in the event of a change of the bending plane, the free end portion of the workpiece may be exposed to movements and accelerations which may lead to oscillations of the free end portion. This effect when oscillating movements of free workpiece portions are generated in the bending process is sometimes designated as the "whiplash effect."

The whiplash effect usually has an adverse influence upon the production rate. Oscillatory movements may even cause undesirable plastic deformations on the bent part. The size, length and consequently the mass or mass inertia of the workpiece and also its rigidity have in this case a decisive influence upon the extent and nature of the undesirable oscillatory movements.

If problems with oscillations of the bent part occur or are expected, the speeds and/or accelerations of the machine axes in the event of oscillation-critical movements are usually reduced to an extent such that oscillations arise only to a non-disturbing extent or, ideally, will no longer arise at all. However, this way of limiting the causes has an adverse effect upon the production rate, since the part is bent more slowly. Alternatively or additionally, steadying times are sometimes programmed between the individual movements so that the oscillations of the already finished portion of the bent part can fade away to an acceptable value before a subsequent workstep of the manufacturing process is carried out. These possibilities for influencing the oscillation behaviour are based on the user's knowledge and ability and presuppose very experienced machine operators. In any event, the production rate of the bending machine is limited by these measures, and therefore, ultimately, the production costs of the bent parts rise.

Furthermore, table tops or other supporting elements are often used to limit the degrees of freedom of the oscillations and/or to damp them by friction. However, such measures require additional outlay in mechanical terms and frequently undesirably restrict bending clearance. Moreover, these are often solutions which are specific to a particular bent part and have to be redeveloped for each bent part or for a group of bent parts. The production costs of the bent parts also rise as a result.

It could therefore be helpful to provide methods and apparatus for the production of bent parts in which the adverse influence of oscillatory movements on the bent part is reduced considerably as compared to conventional methods and apparatuses. It could also be helpful to increase the production rate of bending machines or of the bending process.

SUMMARY

We provide a method of producing a bent part by two- or three-dimensional bending of an elongate workpiece in a bending process including activating and coordinating movements of driven machine axes of a bending machine numerically controlled by a control device, moving at least one portion of a workpiece into an initial position in a region of engagement of a bending tool by one or more feed operations, and forming a portion of the workpiece by bending in at least one bending operation, wherein 1) the movements of the machine axes are generated according to a movement profile predetermined by the control device of the bending machine, 2) the movements of the machine axes include at least one oscillation-relevant movement leading to an oscillation of a free end portion of the bent part, and 3) during the oscillation-relevant movement, a compensating movement is generated in at least one compensation time interval, the compensating movement being effective to at least one of i) reduce a generation of oscillations and ii) subtract oscillation energy from the oscillating free end portion.

We also provide apparatus that produces a bent part by two- or three-dimensional bending of an elongate workpiece including a plurality of driven machine axes, a control device that coordinates activation of movements of the driven machine axes, at least one bending took that carries out a bending operation on the workpiece, wherein, in operation, movements of the driven machine axes are generated according to a movement profile predetermined by the control device, and wherein the apparatus generates during an oscillation-relevant movement leading to an oscillation of a free end portion of the bent part, in at least one compensation time interval, a compensating movement which at least one of 1) reduces a generation of oscillations and 2) removes oscillation energy from the workpiece.

We further provide a computer program product stored on a computer-readable medium or in the form of a signal, wherein the computer program product, when loaded into the memory of a computer and executed by a computer of a bending machine, causes the bending machine to carry out the method.

DETAILED DESCRIPTION

Figure 1:
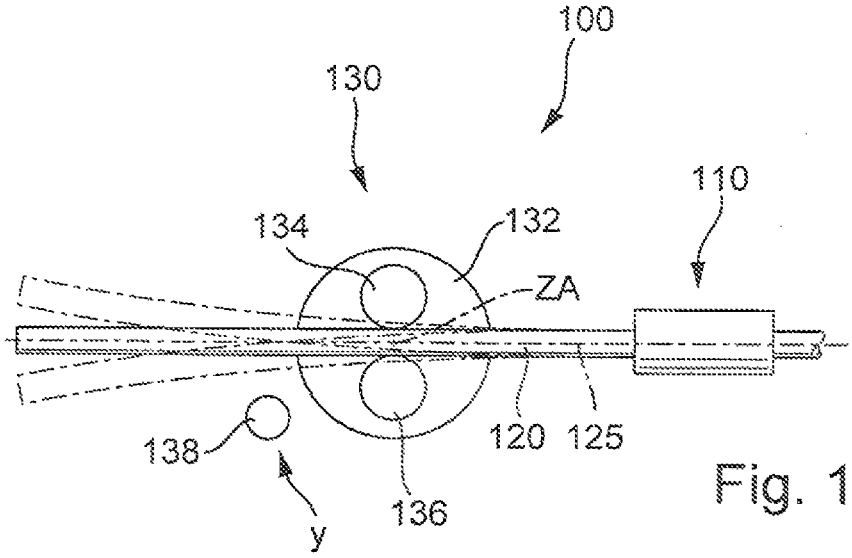
FIG. 1 shows a top view of a bending unit of a single-head bending machine in a diagrammatic illustration.

It will be appreciated that the following description is intended to refer to specific examples of structure selected for illustration in the drawings and is not intended to define or limit the disclosure, other than in the appended claims.

We provide methods for production of bent parts by two- or three-dimensional bending of an elongate workpiece in a bending process comprising:

activating and coordinating movements of machine axes of a bending machine numerically controlled by a control device;

moving at least one portion of the workpiece into an initial position in a region of engagement of a bending tool by one or more feed operations; and forming a portion of the workpiece by bending in at least one bending operation with the aid of the bending tool;

wherein 1) the movements of the machine axes are generated in each case according to a movement profile predetermined by the control device of the bending machine, 2) the movements of the machine axes comprise at least one oscillation-relevant movement leading to an oscillation of a free end portion of the bent part, and 3) during the oscillation-relevant movement, a compensating movement is generated in at least one compensation time interval, the compensating movement being effective to at least one of reduce generation of oscillations and subtract oscillation energy from the oscillating free end portion.

We also provide an apparatus configured to operate according to the method.

To produce the bent part, a numerically controlled apparatus is used, having a plurality of machine axes, the movements of which are controlled with the aid of a computer-assisted control device. Such apparatuses are also designated in this application as CNC bending machines or simply as bending machines. A machine axis includes at least one drive, for example, an electric motor. The drive drives a movable mounted part of the machine axis, for example, a linearly movable slide on a rotatably mounted part. By the coordinated activation of the drives or movements of the machine axes, in a bending process at least one portion of the workpiece is moved into an initial position in the region of engagement of a bending tool by one or more feed operations and formed by bending in at least one bending operation with the aid of the bending tool. The feed operations include, in particular, the drawing-in, positioning and orientation of the workpiece. In this case, the term "drawing-in" means a linear feed movement of the workpiece parallel to the longitudinal axis of an unbent workpiece portion, for example, to convey the latter in the direction of the bending tool. As a rule, "positioning" is likewise achieved with the aid of linear machine axes which involves movements of the workpiece transversely, in particular perpendicularly to the longitudinal axis of the still unbent workpiece portion. In "orientation," the workpiece is usually rotated about the longitudinal axis of the chucked, not yet bent workpiece portion so that the associated machine axis is an axis of rotation (rotational axis). Rotational movements during orientation are used particularly to bring about a change in the bending plane in the case of a bent part which is already bent at least once.

After the workpiece has been moved into an initial position in the region of engagement of a bending tool by one or more feed operations, it is formed by bending in at least one bending operation with the aid of the bending tool. During the bending operation, typically at least one rotational axis of the bending machine is driven, for example, to rotate a bending pin in relation to a stationary bending mandrel and thereby to generate, on a workpiece portion lying between the bending pin and bending mandrel, a bend with a predeterminable bending radius and bending angle.

Each movement of a machine axis is carried out according to a movement profile which is predetermined by the control device on the basis of a computer program. For this purpose, the drive of the machine axis is correspondingly activated or supplied with power. The movement profile may be characterized, for example, by the travel or angle covered during the movement, by the speed and/or by the acceleration of the movement, in each case as a function of time or other parameters. The parameters for the movement profiles depend on the type and size of the bent part to be produced and, for example, when the bending machine is set up for a bending process, can be entered in an input routine by a machine operator by suitable input parameters. In many apparatuses, for example, the magnitude of the speed and of the acceleration of movements or movement segments can be predetermined. Sometimes, it is also possible to select between different acceleration profiles for an acceleration phase.

Many of the movements of machine axes which proceed in a coordinated manner in a bending process lead on account of mass inertia to oscillations of the free end portion, projecting beyond the chucking, of the bent part, above all when this free end portion is already bent once or more than once or possesses a large free length without bending. Those movements of machine axes of the bending machine which may lead to an oscillatory movement, possibly disturbing the bending process, of the free portion of a bent part are designated here as "oscillation-relevant movements."

A particular feature of the method, then, is that, during such an oscillation-relevant movement of a machine axis, a compensating movement of the machine axis is generated in at least one compensation time interval and reduces the generation of oscillations and/or is suitable for subtracting or discharging oscillation energy from an already excited oscillation. The movement profiles of oscillation-relevant movements are in this case modified in a directed manner, as compared with corresponding movement profiles of conventional methods, in such a way that oscillations of a disturbing extent are suppressed from the outset and/or in such a way that the amplitude of oscillations which have arisen is reduced by the removal of oscillation energy to an extent such that unavoidable residual oscillations are so insignificant that the bending process is virtually not impaired as a result of these. The removal of oscillation energy with the resulting amplitude reduction is also designated as "damping" of the oscillation.

By oscillations being avoided and/or reduced with the aid of controlled movement sequences of at least one machine axis, steadying times can be avoided entirely or, in any event, reduced considerably as compared with conventional methods with the result that it becomes possible, for example, to thread the workpiece into the bending tool more quickly. The production rate of the bending process can thereby be increased considerably. Moreover, speeds and accelerations of oscillation-relevant movements can be increased as compared with conventional methods so that, for example, a bending operation can proceed more quickly than hitherto without being impaired by oscillations of the bent part. To achieve these advantages, there is no need for any additional outlay in mechanical terms. Moreover, controlling the bending process is independent of the geometry of the bent part since the corresponding oscillation reduction measures and/or oscillation suppression measures can, after the input of the bent-part parameters, be implemented at the level of the control software of the control device, where appropriate automatically, semi-automatically or manually on the basis of the operator's experience.

A compensation time interval is a time interval in which at least one machine axis executes a compensating movement optimized specially with a view to avoiding and/or reducing oscillatory movements of the bent part, with this compensating movement preferably being non-uniform. A compensation time interval may extend over the entire time between the starting point and end point of a movement. The entire movement may then take place according to an oscillation-optimized law of motion. It is also possible that part of the movement, for example, its initial phase, is carried out without consideration of oscillation generation and/or oscillation energy removal, and that a compensation time interval extends only over a part of the overall time between the starting point and end point of the movement, for example, over less than about 50% or less than about 30% of the overall time. The starting point and end point of a movement are, as a rule, in each case resting points or standstill points of the movement (movement speed equal to zero).

In many instances, the oscillations of the free end portion of the workpiece are reduced or damped in terms of their oscillation amplitude by the directed removal or discharge of oscillation energy on the basis of directed stipulations for the speed profile for one or more relevant machine axes of the apparatus within a compensation time interval. Oscillation energy removal may be so great that, within a time duration of less than one oscillation period, in particular with a time duration of less than half an oscillation period, the oscillation amplitude is reduced by energy removal to less than about 50% or less than about 30% or less than about 20% of the initial value prevailing before the commencement of energy removal.

At least one machine axis active during an oscillation-relevant movement may be controlled such that, at the commencement of the compensation time interval, positive or negative acceleration, that is to say a change in speed of the machine axis is generated in such a way as to bring about a reduction in a speed difference between the instantaneous movement speed of the machine axis and the corresponding instantaneous movement speed of the oscillating free end portion of the workpiece as compared with the speed difference without the compensating movement. On account of the compensating movement, therefore, an approximation of the movement speeds of the machine axis and of the oscillating workpiece portion occurs. This approximation of the movement speeds corresponds to a reduction in the relative acceleration or differential acceleration between the machine axis and the free end portion. As a result, depending on the time position of the commencement of compensating acceleration, potential and/or kinetic energy can be subtracted from the oscillating workpiece in respect of the phase or time profile of the oscillatory movement.

There are several possibilities for placing that time point at which effectively compensating acceleration can commence. A look at the manifestations of oscillation energy during an oscillation is helpful here.

At a time point of maximum deflection of an oscillatory movement (or of a component of the oscillatory movement), the entire oscillation energy of the oscillatory movement (or of the corresponding component) is stored in the form of potential energy (spring energy, elastic energy) in the free end portion of the bent part. It is subsequently released, converted increasingly into kinetic energy and sets the oscillation in motion. At a time point of maximum oscillation speed which immediately follows the time point of maximum deflection, that is to say after a quarter of the oscillation period, the oscillating end portion of the bent part moves through the zero position or position of rest of the oscillatory movement. At this time point, the elastic deformation of the free end portion has ideally been cut back completely, so that the entire oscillation energy is present in the form of kinetic energy. After passing through the zero position, the free end portion moves in the direction of maximum deflection in the other oscillation direction, and spring energy (potential energy) is built up again as a result of the elastic deformation of the free end portion.

If, then, the commencement of the compensation time interval is placed as near as possible to the time point of maximum deflection of the oscillatory movement, then, above all, the oscillation energy stored in the elastically deformed bent-part portion in the form of potential energy can be discharged from the oscillating portion of the bent part with the aid of the compensating movement. If, by contrast, the commencement of the compensation time interval is placed as near as possible to a time point of maximum oscillation speed (passage through the zero position) of the oscillatory movement, then, above all, oscillation energy present in the form of kinetic energy can be discharged from the oscillating portion of the bent part with the aid of the compensating movement. Mixed forms may be present and, therefore, both kinetic and potential energy are cut back as a result of the compensating movement.

At least one machine axis active during an oscillation-relevant movement may be controlled such that a commencement of the compensation time interval lies, with respect to the time profile of the oscillatory movement, within a first time interval between a time point of maximum deflection of the oscillatory movement and the immediately following time point of maximum oscillation speed. Each oscillation period includes two first time intervals. In a first time interval, the amount of the speed difference increases from zero (at the time point of maximum deflection) to a higher value at the time point of maximum oscillation speed. A compensating acceleration of the machine axis, which is initiated as early as possible after a time point of maximum deflection, may be utilized to prevent the build-up of a critically high speed difference. Gentle accelerations may in this case exert a high damping action.

Alternatively or additionally, there may be provision whereby at least one machine axis active during an oscillation-relevant movement is controlled such that a commencement of a compensation time interval lies with respect to the time profile of the oscillatory movement, within a second time interval between a time point of maximum oscillation speed and the immediately following time point of maximum deflection of the oscillatory movement. If the compensating acceleration of the machine axis is initiated as early as possible after a time point of maximum oscillation speed, what can be achieved is that oscillation energy present predominantly in the form of kinetic energy is removed.

Of a plurality of possible positions of the commencement of a compensating movement, that one at which the free end portion oscillates or intends to oscillate in the reverse direction is often selected, that is to say opposite to the direction of movement of the machine axis. In this case, the compensating movement of the machine axis will commence with a phase of negative acceleration, that is to say with a reduction in the movement speed or a braking movement. For example, a first time interval may be selected such that the maximum deflection of the oscillatory movement which defines the start of the first time interval is a maximum deflection in the forward direction of movement of the machine axis. Then, to be precise, the bent part oscillates in the reverse direction in the first time interval.

Compensating movements with negative acceleration, that is to say braking movements of the machine axis, may be useful especially in the final phase of a machine-axis movement, that is to say temporally shortly before the end point of the movement is reached. The braking movement may then be designed such that, after the compensating braking movement, the machine axis is no longer moved more quickly, but, instead, strives directly to reach its resting point (standstill of the movement of the machine axis) without any further substantial positive acceleration.

However, it is also possible to discharge oscillation energy from the bent part in a phase of forward oscillation of the bent part, in which phase the oscillating portion of the workpiece moves more quickly than the machine axis. It is then possible to remove oscillation energy by positive acceleration of the machine axis. This may be advantageous, for example, in movement phases in which the movement of the machine axis in any case becomes faster, for example, in the initial phase of a bending operation.

The compensation time interval may therefore commence with a speed increase, that is to say with positive acceleration, or with deceleration, that is to say with negative acceleration, while the type of acceleration (positive or negative) should be adapted to the oscillation profile of the bent part in such a way as to bring about immediately a reduction in the acceleration difference at the commencement of the compensation time interval.

A compensating movement may assume the form of a counter-oscillation, in which phases with positive acceleration of the machine axis and phases with negative acceleration of the machine axis alternate once or more than once, for example, to generate an approximately sinusoidal acceleration profile. Such compensating movements may extend over more than half the period length of an oscillation, in particular over at least one or at least two or at least three or more period lengths.

In many instances, an oscillation to be reduced occurs during a bending operation in which the bending tool is in engagement with the oscillating bent part and the bending axis is active. In this case, the oscillation energy, present in the bent part and/or in the movement of the bent part, of the oscillation component lying in the bending plane can be discharged by the bending tool which carries out a compensating movement. The compensating movement of the bending tool thus actively reduces the oscillatory movement.

A compensating movement may basically be provided in all machine axes to partially or completely discharge from the oscillating system the energy of an oscillation component assigned to the machine axis, for example, also on a draw-in axis. Where appropriate, a plurality of machine axes may also be activated simultaneously such that energy is subtracted from a plurality of oscillation components of a more complex oscillatory movement (for example, planar oscillation and torsional oscillation).

For the effectiveness of active removal of oscillation energy by a compensating movement, it is important to hit that time window of the oscillatory movement in which the oscillation energy can be discharged optimally during a specific phase of the movement. Especially suitable time intervals amount in each case to only one quarter of an oscillation period, the absolute size of the time window being dependent on the oscillation frequency of the oscillating end portion.

A sufficiently accurate, effective method which can be implemented especially cost-effectively and, where appropriate, can be put into effect solely by suitable software components for the control software is based on the calculation of characteristic frequencies of the oscillatable free end portion of the workpiece during the bending process. If a CNC bending machine is set up for carrying out a bending process, inter alia, inputs for defining the desired geometry of the finished bent part are required. The bent-part geometry may be defined online or offline, for example, by structured input of geometry data (for example, particulars on the bending radii, bending angle and orientation of the bending plane of planar bends, the length of adjoining unbent legs, parameters of helices provided where appropriate or the like). In addition, as a rule, workpiece data are input or read in from a memory, for example, data on the workpiece cross section, workpiece diameter, type of material, density of the material or the like. From these data, inter alia, the mass distribution and mass moments of inertia of the free end portion can be calculated for each phase of the bending process.

In one method, using the geometry data of a bent part and workpiece data, eigenfrequencies or eigenfrequency data are calculated, which represent one or more eigenfrequencies (resonant frequencies) of the oscillatable free end portion of the workpiece for one or more successive phases, in particular for all the phases of the bending process.

If, furthermore, for a definable reference time point of the oscillation, the phase position of the latter is stipulated or determined, then, using the eigenfrequencies or data which represent the eigenfrequency or the eigenfrequencies in suitable form, the profile, following this reference time point, of the oscillatory movement can be predetermined exactly in terms of its phase position. The definable reference time point may be, in particular, the time point of the commencement of an acceleration movement after a resting point (standstill) of the movement of a machine axis. During a bending operation, the reference time point may be, for example, the commencement of the acceleration movement of a bending pin after the bending pin has been applied to the workpiece (where appropriate, still resting or only slightly oscillating).

In particular, there may be provision whereby the time position of the commencement of a compensation time interval is controlled, using eigenfrequency data and data on the phase position of the oscillation at a defined reference time point lying at an earlier time.

In another method, using suitable geometry data of a bending process and workpiece data, moment-of-inertia data are calculated which represent the mass moment of inertia of the oscillatable free end portion of the workpiece for one or more successive phases, in particular for all the phases of the bending process, and the extent of accelerations during the movement of machine axes is controlled as a function of the mass moment of inertia or of the corresponding data. For example, the acceleration can be reduced automatically, the higher the mass moment of inertia of the oscillatable free end portion is to avoid more pronounced oscillations.

A time profile of the oscillatory movement may be detected by an oscillation detection system which preferably has at least one oscillation sensor which generates an oscillation signal representing at least the phase position and the frequency of the oscillation. An oscillation sensor is a measurement system which can detect movements (and therefore also oscillations) of the free end portion and can convert them into, for example, electrically further-processable signals. Consequently, for each bent part, the oscillation can be monitored individually in real time and, for example, the time position of compensating movements can be adapted optimally to the oscillation movement.

The oscillatory movement detected by the oscillation detection system can be displayed on an indicator of the bending machine and be used by an operator to set the parameters for the compensating movement (for example, time position of the commencement, movement profile and the like). Preferably, the oscillation signal is supplied to the control device, and the control device processes the oscillation signal for the purpose of controlling the movement profile of one or more machine axes, so that these execute an effective compensating movement. Automated oscillation detection allows optimal coordination of the compensating movement with the oscillation actually present on the bent part so that, in any event, optimal oscillation reduction can be achieved in each bent part of a series. Thus, oscillation compensation regulation can be implemented. In particular, the control device may be set up such that the time position of the commencement of a compensation time interval is controlled by the oscillation signal. It is thereby possible, for example, that the time point of the commencement of a braking or speed-increasing movement of a machine axis is automatically hit optimally with respect to the phase of oscillation of the bent part to achieve effective oscillation reduction.

The oscillation detection system may have one or more oscillation sensors. An oscillation sensor may operate according to different principles. It may be, for example, an optical oscillation sensor which, for example, detects the oscillation of the bent part optically with the aid of a laser. Alternatively or additionally, a camera system with at least one line-scanning or area-scanning camera, if appropriate with a connected image-processing system, may be provided. Where appropriate, in addition to the phase position and the frequency of the oscillation, its amplitude may also be detected, with time resolution, at a specific measurement point on the free end portion. It is also possible to use at least one inductive or capacitive oscillation sensor to detect oscillations electromagnetically. Selecting suitable elements for the oscillation detection system should take into account the fact that, where appropriate, not only planar oscillations, but also more complex oscillation states such as torsional oscillations and superpositions of a plurality of oscillation components in different directions, should be detected with time resolution. An oscillation detection system should, where appropriate, be capable of detecting two-dimensional and even three-dimensional oscillatory movements and, if appropriate, of generating specific oscillation signals in each case for a plurality of oscillation components.

At least one force sensor or torque sensor may be used as an oscillation sensor to detect with time resolution the oscillation or the forces which occur in this case. For example, a force sensor may be provided to detect the bending force active on the bending tool, for example, with time resolution and/or as a function of the bending angle. On a force sensor, an oscillation component active parallel to the bending direction is reflected as a periodic change in the force required for the bending operation, the force being relatively low when the free portion oscillates in the direction of the bending movement (in the forward direction) and being relatively high when it oscillates counter to the bending direction (in the reverse direction).

Similarly, for example, a fraction of torsional oscillation of the free end portion can be detected by a force sensor or torque sensor on the chucking device (collet) of the workpiece draw-in. An oscillation component acting parallel to the draw-in direction can also be detected, with time resolution, by a correspondingly designed force sensor and can be used for monitoring the oscillation. If appropriate, the power consumption of the drive motor belonging to a machine axis may also be monitored and used for characterizing the bent-part oscillation.

A single oscillation sensor may be sufficient, but a plurality of oscillation sensors are also often provided which, where appropriate, allow more exact characterization and/or the characterization of the more complex oscillation states.

The movement profiles of movements of conventional bending machines are frequently distinguished in that they have an essentially triangular form or an essentially trapezoidal profile of the movement speed. Such speed profiles composed of rectilinear segments arise, for example, when only constant accelerations and maximum speeds can be input for a machine axis on a bending machine, for example, to stipulate the rotational movement of a bending tool. In many bending machines, specific acceleration ramps with a non-uniform speed change can also be stipulated. For example, starting can commence with low acceleration, acceleration thereafter being increased gradually.

By contrast, movement profiles of movements with active oscillation compensation are frequently distinguished in that, in the compensation time interval, at least one change between a phase with negative acceleration, a subsequent phase with positive acceleration and a subsequent phase with negative acceleration is generated. These phases merge one into the other preferably continuously, that is to say without an abrupt change between speed increase and speed reduction so that, for example, an approximately sinusoidal profile of the movement speed with a multiple change between positive and negative acceleration can be obtained in the compensation time interval.

It is often advantageous if, in the case of such "counter-oscillation" generated by activation of a machine axis, the amplitude of the counter-oscillation gradually decreases. As a result, oscillation energy can be subtracted successively from the end portion oscillating with ever lower amplitude, and the situation can be avoided where the counter-oscillation itself excites undesirable bent-part oscillation. By early counteraction, more pronounced amplitudes can, where appropriate, be prevented.

A compensation time interval may follow a phase with constant speed or constant acceleration of the machine axis. The compensation time interval may end, for example, when the movement end point provided for the machine axis is reached, or else, if appropriate, even beforehand. In a bending operation, this may mean, for example, that, first, in the initial phase a pendulum oscillation may build up which is damped in the final phase of the bending operation such that the free end portion of the bent part no longer oscillates or oscillates only uncritically slightly at the end of the movement so that the fading away of an oscillation no longer has to be awaited at the end of the movement, but, instead, the following operation can be initiated without a steadying time or with only a short steadying time.

A movement profile of an oscillation-relevant movement often has between a starting point and end point, in this order, an acceleration time interval with rising movement speed, if appropriate a constant-travel time interval with an essentially constant movement speed and a compensation time interval, in which the movement speed fluctuates and/or falls in a defined manner to achieve oscillation damping.

It is also possible to control the movement of the machine axis throughout the entire movement such that the inertia forces acting upon the free end of the bent part are from the outset kept so low that the oscillations of the bent part, which are scarcely to be avoided entirely in principle, have only a relatively low amplitude and therefore do not impair the bending process or impair it only insignificantly. For this purpose, in many instances, the movements of machine axes (one or more) are controlled such that a movement profile of an oscillation-relevant movement obeys between a starting point and an end point of the movement, a law of motion which corresponds essentially to a mathematically smooth function. A "smooth function" is understood to mean a mathematical function which is continuously differentiatable, that is to say possesses a continuous derivative. Clearly, the graph of a continuously differentiatable (smooth) function has no corners or salient points, that is to say places where it cannot be differentiated. If the movement profile corresponds to a smooth function, there are no abrupt changes (corners in the speed profile or acceleration profile) either for the movement speed or for the movement acceleration. As a result, jolt-free laws of motion, that is to say laws of motion without acceleration jumps, can also be ensured. It has become apparent that, with a suitable design of the movement profile, the formation of disturbing oscillations can thus be kept low from the outset.

Both the speed and the acceleration may vary continuously during the entire oscillation-optimized movement so that the movement profile has no linear segments between the starting point and end point. It is also possible, however, to execute part of the movement profile with a rectilinear segment. For example, the region around a turning point of a smooth movement profile may have a rectilinear segment. This may be beneficial, for example, from a programming point of view.

It has become apparent that oscillation excitation can usually be suppressed especially well when a machine axis is moved according to a law of motion which has an especially low acceleration characteristic value (second derivative of a law of motion). It may also be advantageous if the movement additionally has an especially low jolt characteristic value (third derivative of the law of motion). The law of motion may be capable of being described in good approximation, in particular, by at least one of the following laws of motion: a polynomial of nth degree, in particular fifth degree; a quadratic parabola; a modified acceleration trapezium.

While the damping of oscillations may be understood as being an effect-limiting measure, this active suppression of the build-up of oscillations may be understood as being a cause-limiting measure. A compensating movement often has both cause-limiting and effect-limiting fractions.

We also provide an apparatus for the production of bent parts by two- or three-dimensional bending of an elongate workpiece, in particular a wire or tube. The apparatus has a plurality of machine axes, a control device for the coordinated activation of movements of the machine axes, and at least one bending tool for carrying out a bending operation on the workpiece, movements of machine axes being capable of being generated according to a movement profile predeterminable by the control device. The apparatus is distinguished in that it is set up for generating during an oscillation-relevant movement in at least one compensation time interval, a compensating movement which reduces the oscillation generation and/or which subtracts oscillation energy from an excited oscillation.

"Bending machine" is to be interpreted broadly in the sense that the workpieces produced have one or more bends. Bends may be generated in various ways. In addition to bending machines, which mainly bend, the term also embraces, for example, leg-spring machines which can carry out different operations, such as bending, coiling, winding, the generation of legs and the like. The bent parts may have complex geometries with spring portions, legs and bends.

The characteristics of the compensating movement (for example, the movement profile, the time position of the commencement of a non-uniform compensating movement, acceleration profile and the like) may be calculated individually for each movement of a machine axis on the basis of the eigenfrequencies, determined arithmetically by the machine software, of the oscillations of the bent part and boundary conditions, such as support, friction, orientation and the like. The operator therefore has to carry out only a few inputs characteristic of the bent part. These include, for example, bending lengths, bending angles, straight lengths, bending planes and other geometry data and also workpiece data, for example, on the material, on the workpiece cross section or workpiece diameter and on the density of the workpiece. On the basis of the material cross section, for example, a simple distinction can be made between wire-shaped and tubular workpieces. The indication of the density makes it possible to calculate the moment of inertia and therefore the eigenfrequencies of the free bent-part portion.

In many modern bending machines, particularly in those with regulated machine axes and servo drives, we can use drives and controls already present. We can also use additional program parts or program modules in the control software of computer-assisted control devices.

We further provide a computer program product which is stored, in particular, on a computer-readable medium or is implemented as a signal, the computer program product, when loaded into the memory of a suitable computer and executed by a computer, causes the computer to carry out our methods or a preferred aspects thereof.

This and further features may be gathered not only from the appended claims, but also from the description and the drawings, wherein the individual features can in each case be implemented singularly or in a plurality in the form of subcombinations and in other fields and can constitute advantageous and independently patentable versions. Representative examples are illustrated in the drawings and are explained in more detail below.

In bending, a distinction is made between different types of bending machines and bending methods. Known computer-numerically controlled bending machines for tubes or wires are often designed for the draw-bending method or the roll-bending method. The following examples relate to variants of a roll-bending method for wire bending with the aid of an apparatus, designated as a bending machine, for the production of a bent part.

Bending machines are subdivided basically into single-head bending machines and double-head bending machines, in both machine types either the bending head or the workpiece being rotated. Likewise, either the workpiece or the bending head can be positioned perpendicularly and parallel to the workpiece axis. The term "workpiece axis" here designates the longitudinal axis of the elongate workpiece directly at the workpiece draw-in or at a feed unit, that is to say where the workpiece is chucked and has not yet been bent.

Any movement of the workpiece may be oscillation-critical or oscillation-relevant and should therefore be taken into account in production planning The workpiece movements include workpiece advance, that is to say movement of the workpiece parallel to the workpiece axis, workpiece rotation, that is to say rotation of the workpiece about the workpiece axis, bending of the workpiece about an axis (bending axis) substantially perpendicular to the workpiece axis, and positioning of the workpiece by linear translational movements substantially perpendicularly to the workpiece axis. Moreover, the feed of the blank and the delivery or transfer of the workpiece to a further machining station could be oscillation-critical.

Some aspects of the problems regarding oscillation are explained below by the example of a single-head wire-bending machine in which to bend the wire, a bending head is rotated in relation to a workpiece (wire) retained by a feed unit. The bending head can be positioned in directions perpendicular to the workpiece axis, positioning in the workpiece-axis direction being achieved by movements of the feed unit parallel to the workpiece axis.

Figure 2:
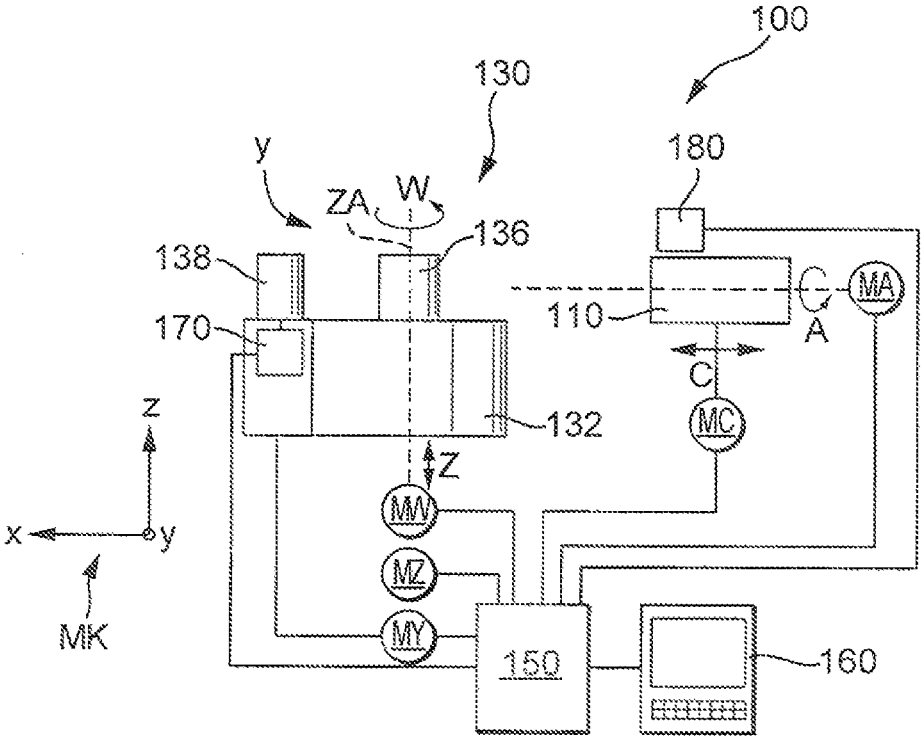
FIG. 2 shows a diagrammatic side view of the bending unit with drives for the machine axes and with devices for controlling an operating the bending machine.

Turning now to the drawings, FIG. 1 shows a top view of a bending unit 100 of a single-head bending machine in a diagrammatic illustration. FIG. 2 shows a diagrammatic side view of the bending unit with the associated drives for the machine axes and with devices for controlling and operating the bending machine. The bending unit has a feed unit 110 which serves for feeding a still unbent workpiece 120 into the region of engagement of a bending tool 130, which is also designated below as a bending head. The feed unit may have, for example, a gripper or a collet or may possess advancing rollers which convey, in the direction of a bending tool, a still unbent portion of the workpiece coming from a workpiece stock (for example, wire coil, winder) and guided by an interposed straightening unit. The position and orientation of the workpiece axis 125 of the still unbent workpiece are fixed by the feed unit.

The bending head 130 serving as bending tool has a mandrel plate 132 which is rotatable about a central axis ZA and on the top side of which are arranged two bending mandrels 134, 136 arranged at a distance from one another, and also a bending pin 138 which is arranged at a radial distance from the central axis ZA and which is pivotable about the central axis of the mandrel plate 132.

The bending tool (bending head 130) and the workpiece 125 or feed unit 110 can be positioned and oriented with respect to one another, as desired. For this purpose, generally, three linear machine axes perpendicular to one another and an axis of rotation (about the workpiece axis 125) are mostly provided. These machine axes may be provided on the bending head 130 or on the feed unit 110. A combination of workpiece positioning and bending-head positioning is mostly employed. The bending head is normally equipped with two or three axes of rotation and may be displaceable about an axis parallel to the workpiece axis.

The bending machine has a right-angled machine coordinate system MK, identified by the lower case letters x, y and z, with a vertical z-axis and horizontal x- and y-axes, the x-axis running parallel to the workpiece axis 125. The machine axes, which are driven by automatic control and are designated in each case by upper case letters (for example, A, B, C, W, Z), are to be distinguished from the coordinate axes.

The bending head 130 can be positioned linearly perpendicularly to the workpiece axis 125 in two mutually perpendicular directions, and the workpiece 125 can be rotated about its workpiece axis and positioned in the axial direction. A conventional designation of the machine axes is explained with regard to FIG. 2. The feed unit 110 (sometimes designated as a "collet feed") can be moved rectilinearly parallel to the workpiece axis (and therefore parallel to the x-axis) with the aid of a linear C-axis (sometimes designated as a collet feed). The drive for this purpose takes place with the aid of a servo motor MC. A (theoretically) unlimited rotation of the workpiece about the workpiece axis 125 is possible with the aid of the A-axis (workpiece axis of rotation), a servo motor MA serving as the drive here. The other machine axes are assigned to the bending tool 130. The bending head 130 can be rotated to an unlimited extent about the central axis ZA (running parallel to the z-axis of the machine coordinate system) with the aid of a servo motor MW of the W-axis. The bending pin 138 can be pivoted to an unlimited extent about the central axis ZA of the bending head with the aid of a servo motor MY of the Y-axis. The central axis ZA in this case defines the mid-point of the bend and is therefore also designated as the bending axis. The bending tool may move linearly as a whole in two directions perpendicular to the workpiece axis, to be precise by a Z-axis, running parallel to the central axis ZA, with the aid of a motor MZ and by a B-axis (not shown), running perpendicularly to the Z-axis, with the aid of a motor (not illustrated). The motors for linear movements may in each case be servo motors or electric linear drives (direct drives).

In the example, the axis of rotation of the bending movement runs in the vertical direction so that the B-axis serves for the horizontal positioning and the Z-axis for the vertical positioning of the bending head. The bending head can be obliquely pitched manually or by servo motor.

All the drives for the machine axes are connected electrically conductively to a control device 150 which contains, inter alia, the power supplies for the drives, a central computer unit and memory units. With the aid of the control software active in the control device, the movements of all the machine axes can be controlled variably with high time resolution, for example, to vary movement speeds and accelerations of the bending axis in a directed manner during a bending process. An indicator and operating unit 160 connected to the control device serves as an interface with the machine operator. The latter can enter at the operating unit specific parameters relevant to the bending process, for example, the desired bent-part geometry (geometry data) and various workpiece properties (workpiece data) and tool data, before the bending process commences.

FIG. 1 illustrates a problem occurring during bending which arises due to the fact that a free end portion of the workpiece chucked into the feed unit has been set in oscillation. In the illustration of FIG. 1, the workpiece 120 is located at a distance above the bending head which is lowered downwards with the aid of a Z-axis, so that the workpiece axis 125 runs above the bending mandrels 134, 136 and, therefore, the wire is not in engagement with these. Owing to preceding workpiece movements, the workpiece has been set in oscillations having a considerable oscillation component in the plane (bending plane) perpendicular to the bending axis ZA. These oscillations are illustrated by dashes in FIG. 1. Since the bending mandrels 134, 136 are at a distance from one another which is only slightly greater than the workpiece diameter, it is possible to thread the workpiece 125 in between the bending mandrels only when the workpiece oscillations have faded to an extent such that, when the bending head is moved up, the oscillating workpiece fits between the bending mandrels without being in contact with these.

Figure 3:
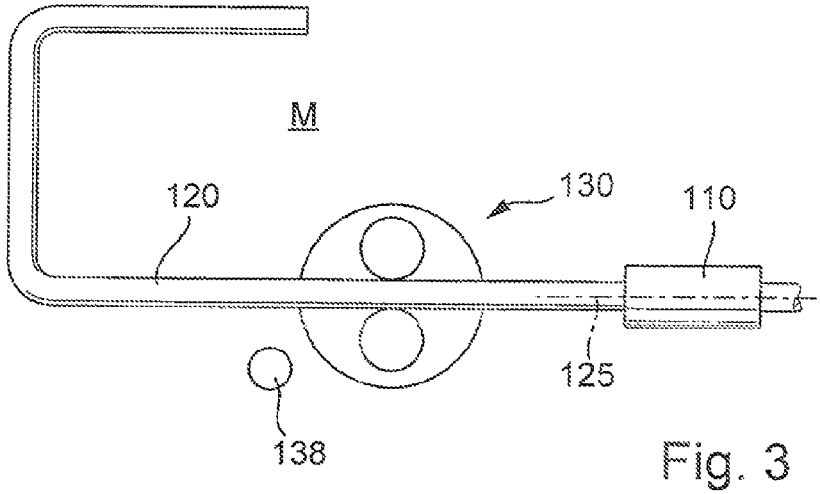
FIG. 3 shows a top view of an already multiply bent workpiece.

An illustration similar to that in FIG. 1 is selected in FIG. 3, but here part of the workpiece 120 has already been provided with bends. Due to the projection of the partially bent workpiece 120 and to the associated displacement of the mass center of gravity M of the workpiece, the latter tends to oscillate to an even greater extent than the not yet bent workpiece in FIG. 1. Since the mass center of gravity of the workpiece no longer lies on the workpiece axis 125, oscillation of the workpiece which disturbs the bending process may be excited during any positioning (in the direction of the workpiece axis and also perpendicular thereto) associated with workpiece movements and during any orientation, that is to say during any rotation about the workpiece axis.

To explain the problems with regard to oscillation in more detail, an exemplary bending operation during the production of a three-dimensionally bent wire bent part is explained below. The bending sequence may theoretically be subdivided into individual segments, even though, in reality, a plurality of segments may proceed simultaneously. During drawing-in before the first bend is generated, the straight wire is conveyed forwards into the region of the bending tool, for example, with the aid of draw-in rolls (C-axis). The braking of the wire is usually uncritical in terms of oscillation, since, theoretically, transverse oscillations are not yet generated as a result of this. During subsequent threading-in, the bending head moves upwards with the aid of the Z-axis and the wire is threaded in between the bending mandrels of the bending tool.

In this case too, there are still usually no problems because the wire does not oscillate or oscillates only minimally. The distance between the two bending mandrels is typically dimensioned such that it is a few tenths of a millimeter greater than the outside diameter of the wire.

In the example illustrated, in the subsequent phase of starting, the bending pin executes a pivoting movement about the bending axis (central axis ZA) (movement of the Y-axis) and the mandrel axis (W-axis) is stationary. The bending pin can move, for example, with constant acceleration from the threading-in position into an application position in which the bending pin touches the wire for the first time.

During the first bend, the bending pin can move over this application position without stopping, but it can also be stopped automatically, for example, when data on the geometry of the tool and the material diameter are present, so that the forming operation commences with acceleration from a standstill. During the first acceleration acting on the wire, an oscillation of the free end portion, projecting beyond the bending tool, of the wire is excited. In the subsequent phase, the wire is accelerated further and, on account of its oscillations, it periodically comes to bear to a different extent against the bending pin in the bending plane. It is also possible that the bending pin reaches its final speed even before it moves onto the wire. If the bending angle is sufficiently large and the bending pin has reached a maximum bending speed predetermined for the bending process, bending subsequently takes place at a constant speed. Thereafter, the wire is braked again with predeterminable, for example, constant acceleration until the overbending angle is reached (braking) The bending pin is then reversed (Y-axis) and accelerates again to a predetermined speed, in which case the acceleration and speed may differ from the corresponding values during bending. Departure may take place, for example, in two steps (first slowly and then more quickly). The bending operation is thereby concluded. The tool then sometimes moves downwards out of the wire with the aid of the Z-axis (unthreading), although this step may also be dispensed with, for example, when the bending direction does not change.

If a plurality of bends are to succeed one another in a bending plane, this sequence may be repeated. In the production of three-dimensionally bent parts, at least one change of the bending plane takes place. If the next bend takes place in another plane, then, after unthreading, the feed unit is rotated with the aid of the A-axis so that the workpiece rotates about its workpiece axis. In this case, torsional oscillation may arise and, in addition, the already bent end may execute flexural oscillation. The wire is subsequently reconveyed with the aid of the C-axis (draw-in). However, the drawing-in method is substantially more critical in this phase than before the first bend is generated because the already bent wire is substantially more susceptible to oscillation on account of its higher mass inertia and, where appropriate, the displacement of its center of gravity away from the workpiece axis. The second threading-in is also correspondingly more difficult on account of the workpiece oscillation since, during threading-in, the oscillating wire may collide with the mandrel pins, and therefore the mandrel pins may transmit an oscillation-exciting pulse to the wire.

In different bending processes, these basic segments may take place and, where appropriate, be repeated with varying frequency and in other sequences. It must be remembered that, in each segment of a bending process, oscillations may arise which have the previously generated oscillations superposed upon them.

In many instances, during an oscillation-relevant movement of a machine axis, what is generated in a compensation time interval is a non-uniform compensating movement of the machine axis, the movement profile of which is designed such that a large part of the energy can be removed from an oscillatory movement of the bent part in a short time. As an illustration of this, FIG. 4 shows the movements of a workpiece to bent in various phases of a bending operation. The part-figures show in each case a bending tool 130 with two stationary bending mandrels 134, 136 of the mandrel plate and also with a bending pin 138 which executes the relative rotational movement during the bending of the wire 120. The dashed line in the middle of the wire in FIG. 4A symbolizes in each case the position of rest or the zero position of the wire, that is to say that orientation which the longitudinal axis of the wire would assume in the absence of external forces.

Figure 4A:
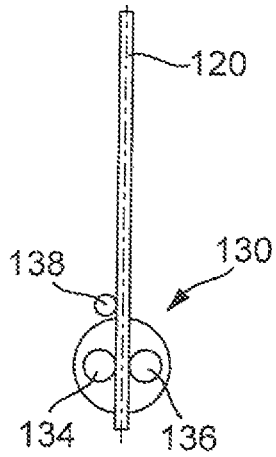
FIG. 4 shows diagrammatically movements of a workpiece to be bent, in various phases of a bending operation.
Figure 4B:
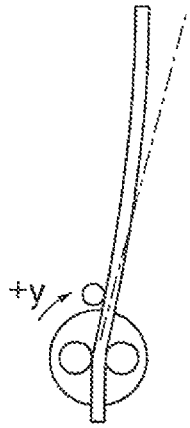
Figure 4C:
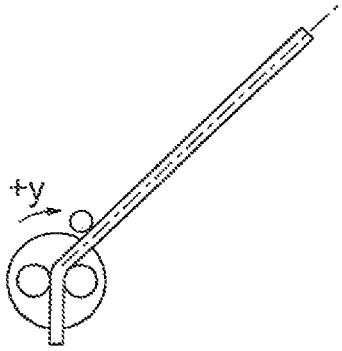
Figure 4D:
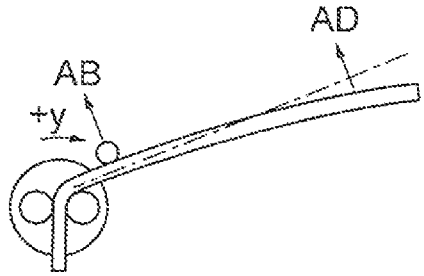
Figure 4E:
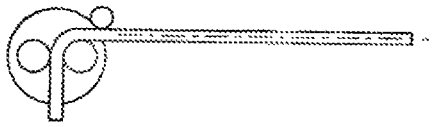

FIG. 4A shows the arrangement at the time point t=t1. The wire bears against the bending pin, and the wire is still in its position of rest. The acceleration of the bending pin 138 in the bending direction (+Y-direction) then takes place. In this case, on account of mass inertia, the wire bends in the direction of the bending pin, that is to say in a reverse direction opposite to the direction of movement of the bending pin. At the time point t=t2 (FIG. 4B), the wire has reached its maximum deflection in the reverse direction. In this situation, the wire is deformed elastically, and the full energy of a planar oscillation arising is stored in the wire in the form of potential energy (spring energy). After the time point t=t2, the wire accelerates in the forward direction and at the time point t=t3 reaches the position, shown in FIG. 4C, in which the wire moves over the position of rest. In the time interval between t=t2 and t=t3, the wire increasingly converts the stored potential energy into kinetic energy. In this phase, the free end moves more quickly than the bending pin (higher angular speed) in a forward direction. At the time point t=t3, the free end portion reaches its maximum oscillation speed and moves over the position of rest. The oscillation energy is present virtually solely in the form of kinetic energy. After having moved over the position of rest, the wire slows its oscillation speed again and converts the kinetic oscillation energy into spring energy again, until the wire reaches its maximum deflection in the forward direction at the time point t=t4 (FIG. 4D). At this time point, the wire has the same speed as the bending pin. The phase of reverse oscillation opposite to the bending direction then commences, until, during the reverse oscillation, the wire reaches its maximum oscillation speed again when it passes through the zero position (position of rest). The first oscillation period is thereby concluded. During a bending operation, many such oscillation periods may take place in succession.

Figure 5:
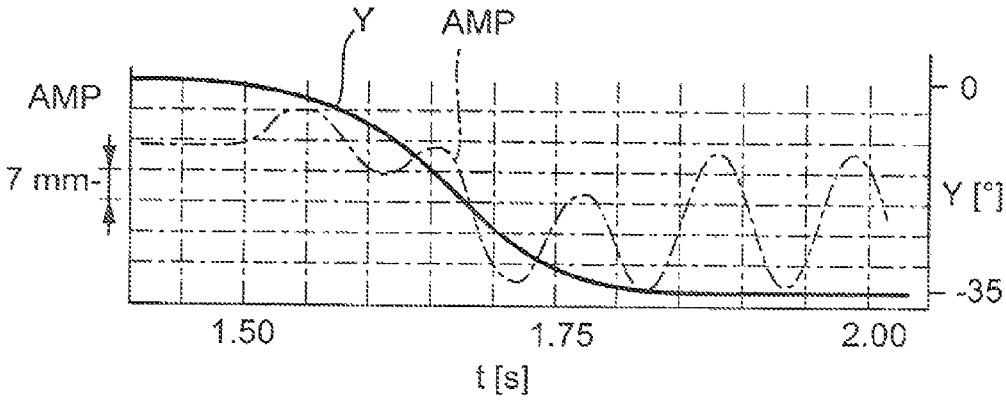
FIG. 5 is a graph which shows the bending angle of a bending pin and the amplitude of a generated oscillatory movement in a joint illustration.

FIG. 5 shows a measurement graph plotted during a test which illustrates this sequence. The obliquely running straight line with sine terminations represents the bending angle Y [°] as a function of the time t, the amplitude of the wire oscillations being illustrated by the sinusoidal curve AMP. Oscillation commences when the bending pin is applied at approximately t=1.50 s. The free end portion experiences acceleration in the bending direction for the first time. With the first acceleration by the bending pin, oscillation is excited and continues, during bending, with somewhat growing amplitude.

An active reduction in the amplitude of the flexural oscillation generated may be achieved in that the movement of the bending pin in the bending direction (that is to say, the bending angle Y increases) is braked or decelerated within a first time interval between a time point of maximum deflection of the oscillatory movement in the forward direction (for example, at t=t4) and the immediately following time point of maximum oscillation speed. In this case, the bending pin or assigned machine axis (Y-axis) executes a braking movement with finite acceleration which is codirectional with the acceleration of the oscillatory movement of the wire at this time point.

In the example, braking takes place from the time point t=t4 shown in FIG. 4D. Thereafter, the movement of the bending pin is braked. In the figure, the negative acceleration of the bending pin, which is required for braking, is symbolized by the arrow AB. The arrow points in the direction of the acceleration of the bending pin, that is to say rearwards or opposite to the direction of movement (+Y-direction) of the bending pin. The acceleration of the wire after the time point t=t4 of maximum deflection in the forward direction likewise goes in this direction and is illustrated by the arrow AD. In this reverse oscillation phase of the movement, the wire is urged towards it zero position again. As is illustrated clearly, both accelerations point in the same direction (codirectional accelerations). The result of this is that the oscillation of the wire is absorbed, as it were. The bending pin can always brake further, for example, up to a time point t=t5 (FIG. 4E) at which the wire is virtually at rest.

From an oscillatory point of view, the operations in the region of the first time interval from the time point t=t4 may be understood as follows. The bending tool, that is to say the mandrel pins and the bending pin, act, up to the time point t=t4, in the same way as fixed chucking for the wire. The result of the braking of the bending pin after the time point t=t4 is that the chucking is no longer firm, but is elastic, and therefore also has a damping action. The braking of the bending pin during the reverse oscillation of the wire thus generates elastic chucking by a large fraction of the oscillation energy is discharged from the wire.

During bending with an overbending angle, alternatively or additionally, damping in a region with codirectional accelerations of wire and bending pin can be achieved in the phase of the reverse movement of the bending pin (movement in the −Y-direction) after the overbending angle is reached. Depending on the direction in which the wire is deflected at a time point of maximum deflection (forward direction) (+Y-direction) or reverse direction (−Y-direction), for this purpose the bending pin is either positively accelerated or decelerated in the subsequent time interval to absorb the oscillation and discharge oscillation energy for damping purposes.

It is also possible, after overbending, to coordinate commencement of the reverse movement with the oscillatory movement of the free end portion such that damping occurs immediately upon commencement. For this purpose, if required, an intermission of controllable length may be provided in the region of the reversal point, for example, to start the reverse movement exactly when the free end portion commences its reverse oscillation phase.

For active damping, it is important to hit the correct time point for the commencement of the damping compensating movement of the machine axis (Y-axis) of the bending pin. In the example in FIG. 4D, the elastic chucking, which is caused, for example, by the braking of the bending pin, can act elastically only in one direction, to be precise counter to the bending direction. Damping therefore cannot take place at any desired time point, but should lie within a time window which corresponds to that phase of oscillation in which the wire moves in the direction of the bending pin (cf. FIG. 4D). This time window amounts to only ¼ of the oscillation period of the bent part, the absolute size of the time window (in units of time) being dependent on the oscillation frequency which is determined essentially by the eigenfrequency of the oscillating, free workpiece portion. Typical sizes of a time window may lie in the region of a few milliseconds up to a few hundredths of a second, depending on the size or eigenfrequency of the oscillating part (typical values of, for example, about 0.5 Hz to about 10 Hz).

Figure 6:
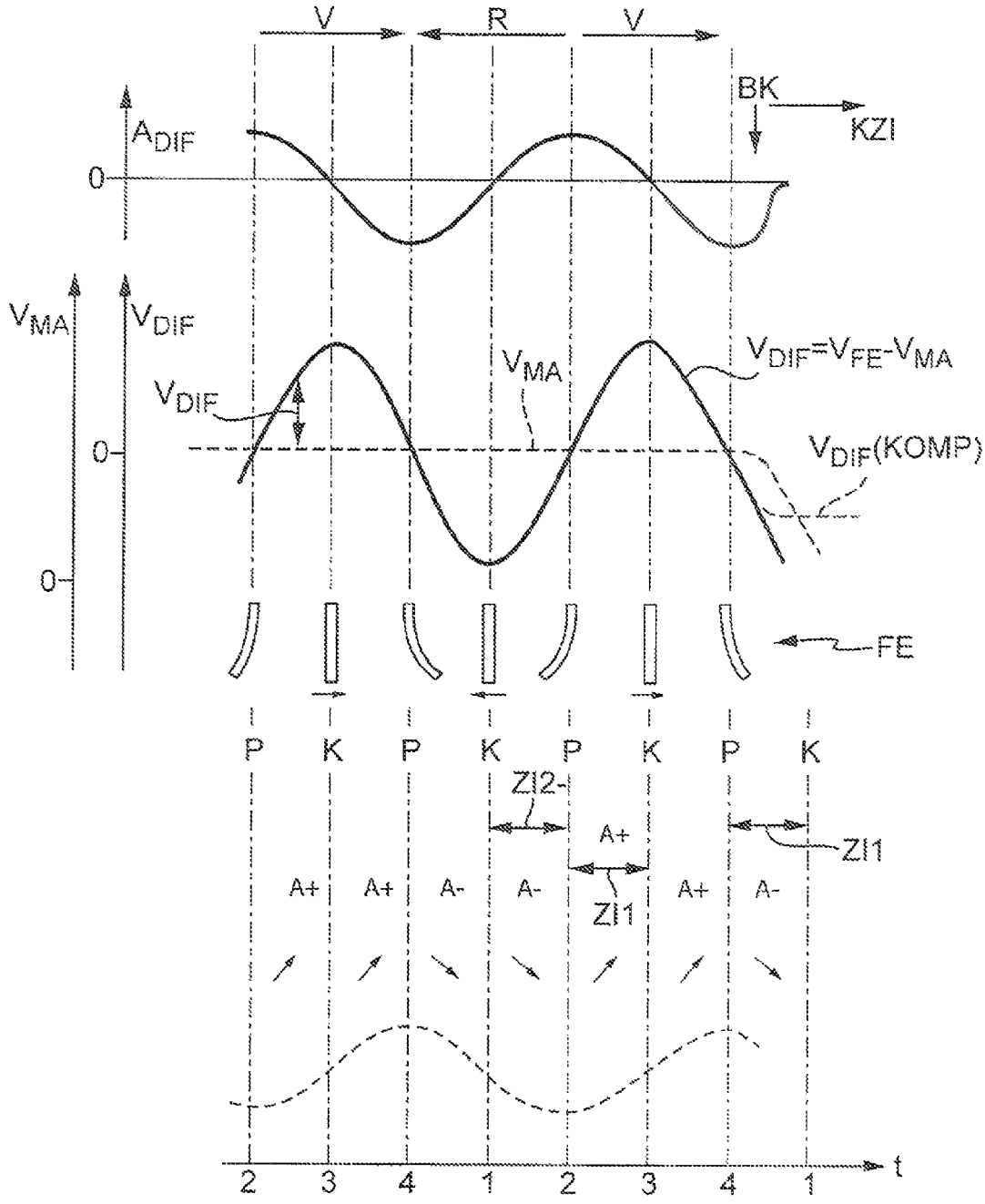
FIG. 6 shows a multi-part graph in which various parameters characterizing the oscillation are illustrated diagrammatically as a function of time.

It is explained more generally, then, in the diagrammatic graph in FIG. 6 how an existing oscillation can be damped by the removal of oscillation energy by a compensating movement, initiated in phase, of the active machine axis (here, the Y-axis for the drive of the bending pin). Various parameters characterizing the oscillation are plotted in the multi-part graph as a function of the time t (x-axis). The vertical lines identified on the time axis by numerals 1 to 4 mark selected time points t1, t2, t3 and t4 of the periodic oscillation. The middle of FIG. 6 shows an oscillating free end portion FE of a bent part being machined, in different phases of an oscillatory movement which runs through the free end portion, while the bending pin is pivoted in its bending direction at a constant angular speed. At the time point t2 shown on the left, the free end portion is deflected at a maximum in the reverse direction, and, at the immediately following time point t3, runs through its zero position in the forward direction (arrow to the right), in order, at the time point t4, to reach maximum deflection in the forward direction. The free end portion then oscillates in reverse, and, at the time point t1, reaches its zero position again with maximum oscillation speed in the reverse direction (arrow to the left), finally, at the subsequent time point t2, to reach the maximum deflection in the reverse direction again after a full oscillation period, etc. Between the time points t2 and t4, movement in the forward direction (V) (the same direction as the bending-pin movement) takes place, while movement in the reverse direction (R) (opposite the bending-pin movement) takes place between the time points t4 and t2.

Directly above the symbols for the free end portion FE, a subgraph shows by a dashed line the speed $V_{MA}$ of the machine axis active during movement, that is to say, in the example, the Y-axis for pivoting of the bending pin. The unbroken sinusoidal line, designated by $V_{DIF}$, represents the differential speed or speed difference $V_{DIF}$ between the (angular) speed $V_{FE}$ of a selected point on the free end portion FE and the (angular) speed of the bending pin or of the driven machine axis. The equation: $V_{DIF}=V_{FE}-V_{MA}$ applies. It is clear that, in the phase of forward movement (V) between t2 and t4, the free end portion first becomes increasingly faster than the bending pin, and, at the time point t3, reaches the maximum speed difference, and that, thereafter, the speed difference decreases again up to the time point of maximum deflection in the forward direction (t4). A speed difference subsequently develops in the opposite direction, since, during reverse oscillation (R) between t4 and t2, the angular speed of the free end portion is in each case lower than that of the bending pin, a maximum speed difference being obtained at the time point t1.

In the uppermost subgraph, the time change of the speed difference $V_{DIF}$ is illustrated as a function of time, that is to say the differential acceleration or acceleration difference $A_{DIF}$. The differential acceleration is a measure of the extent to which and the direction in which the oscillating free end portion is accelerated in relation to the moving bending pin. An acceleration difference is present at any time point outside the time points of maximum oscillation speed (t3 and t1).

Immediately below the symbols for the oscillating free end portion, the energy conditions are symbolized by the letters "P" and "K." Whereas, at the time points t2 and t4 of maximum deflection in the reverse direction or the forward direction, the entire oscillation energy of this oscillation, assumed to be planar oscillation, is present in the form of potential energy (P) or spring energy, at the intermediate time points of maximum oscillation speed (at t3 and t1) the oscillation energy is present solely in the form of kinetic energy (K). In the intermediate time intervals, both energy forms are present, and in this case, for example, the fraction of potential energy still predominates, the nearer a time point considered lies to a time point of maximum deflection.

If, then, oscillation energy is to be subtracted from the oscillating free end portion in any desired phase of oscillation, in that the movement speed $V_{MA}$ of the machine axis (here, of the bending pin) is varied sharply as a result of defined positive or negative acceleration, this is possible when a variation in the speed of the machine axis, that is to say an acceleration, is generated in such a way as to give rise to a reduction in the speed difference $V_{DIF}$ between the instantaneous movement speed $V_{MA}$ of the machine axis and the instantaneous movement speed $V_{FE}$ of the oscillating free end portion of the workpiece as compared with the speed difference without a compensating movement. In other words, oscillation damping or oscillation energy removal can be achieved when the machine axis is accelerated positively or negatively in such a way that the amount of the acceleration difference $A_{DIF}$ is reduced as far as possible.

In FIG. 6, this is explained for a first time interval ZI1 immediately after the time point t4 shown on the right, at which the free end portion has reached its maximum deflection in the forward direction and then begins to oscillate back in the reverse direction (cf. FIG. 4D). At the time point t4, the entire energy is present in the form of potential energy (spring energy) which, during the reverse oscillation, is converted increasingly into kinetic energy. If, the movement of the bending pin is braked (negative acceleration, symbol A−), the bending pin which slows its speed absorbs the oscillatory movement, running in the direction of the bending pin, of the free end portion and thereby removes oscillation energy from it. If the speeds of the bending pin and the free end portion are considered, it can be seen that, after the time point t4, during the reverse movement of the free end portion the speed difference $V_{DIF}$ would be lowered quickly to ever more negative values, until the next zero passage is reached. If, the speed of the bending pin is likewise suitably lowered (negative acceleration) in this phase, the actual speed difference $V_{DIF}$ (KOMP) decreases drastically in relation to that speed difference which would be present without this compensating movement. In the example, the lowering of the bending-pin speed is adapted to the oscillation speed of the free end portion such that virtually a constant speed difference is established after the commencement BK of the compensation time interval KZI, this, in turn, corresponding to a decrease in the amount of the acceleration difference $A_{DIF}$ to virtually zero. The practical effects of such a directed high deceleration of the bending-pin movement are explained further below by some practical examples (cf. FIGS. 7 to 9).

Damping of the oscillation (removal of oscillation energy) can be achieved in principle in any phase of the oscillatory movement by directed sharp acceleration of the moving machine axis. The lower part of the graph illustrates the accelerations required for this purpose in the respective phases by upwardly or downwardly directed arrows and the symbols A+ and A− respectively, an upwardly directed arrow or the symbol A+ standing for a speed increase (positive acceleration) and a downwardly directed arrow or A− standing for deceleration or negative acceleration. As an example, what may be illustrated here is the situation in a second time interval ZI2 which lies between a time point t1 of maximum oscillation speed in the reverse direction and the immediately following time point t2 of maximum deflection in the reverse direction. In this phase, too, the free end portion moves in the direction of the moving bending pin, specifically with a decreasing speed. In this region, too, the oscillation in this phase can be absorbed as a result of deceleration of the bending-pin speed (A−), and oscillation energy can thereby be dissipated.

With a suitable choice of the oscillation phase, oscillation energy removal is also possible by a positive acceleration of the bending pin. What may be described here as an example is a first time interval ZI1 between the time point t2 of maximum deflection in the reverse direction and the immediately following time point t3 of maximum oscillation speed in the forward direction. In this phase of the forward movement of the free end portion, the oscillation can be "absorbed" in that the bending pin is accelerated positively (A+) and, as a result, the speed difference with respect to the free end portion is reduced, as compared with the movement without this acceleration.

The dashed line below the arrows, which represent the acceleration, in the lower part of the graph may likewise be used to illustrate the required acceleration of the bending pin for energy removal.

The examples show that, by the amount of the acceleration difference $A_{DIF}$ between the bending pin and the oscillating free end portion being minimized, oscillation energy can be subtracted and the oscillation amplitude can thereby be reduced. In a method variant, what is achieved with the aid of a regulation of the bending force occurring on the bending pin is that the occurrence of oscillations having disturbing amplitudes is suppressed continuously. To be precise, if regulation is designed such that the bending force remains as constant as possible or has only insignificant fluctuations during the bending operation or during a phase of the latter, this also at the same time ensures that a pronounced acceleration difference cannot be formed between the movement of the bending pin and the oscillatory movement of the free end portion. Since the formation and acceleration differences is ultimately responsible for the excitation of oscillations of the free end portion, the excitation of disturbing oscillations can also thereby be avoided. The rise or fall of the force at the start or at the end of a movement is in this case to be taken into account.

Figure 7:
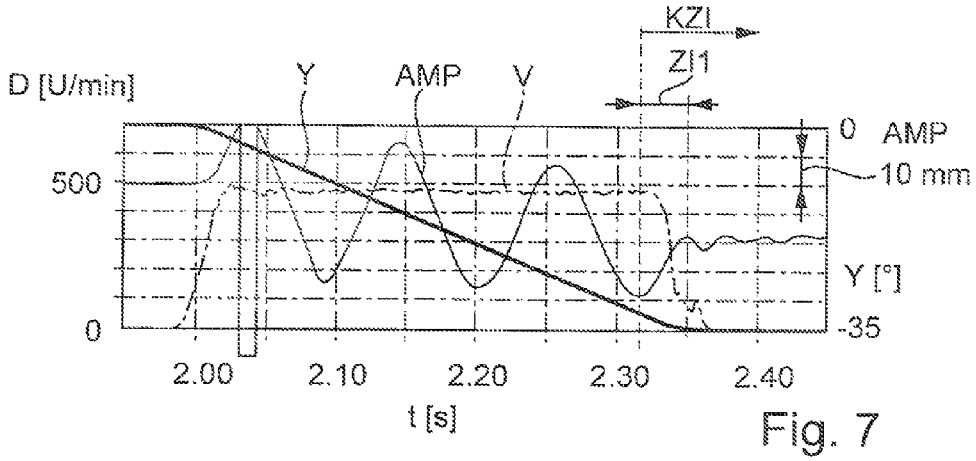
FIG. 7 shows a measurement graph of a first experiment of a bending operation with active damping of the oscillatory movement.
Figure 8:
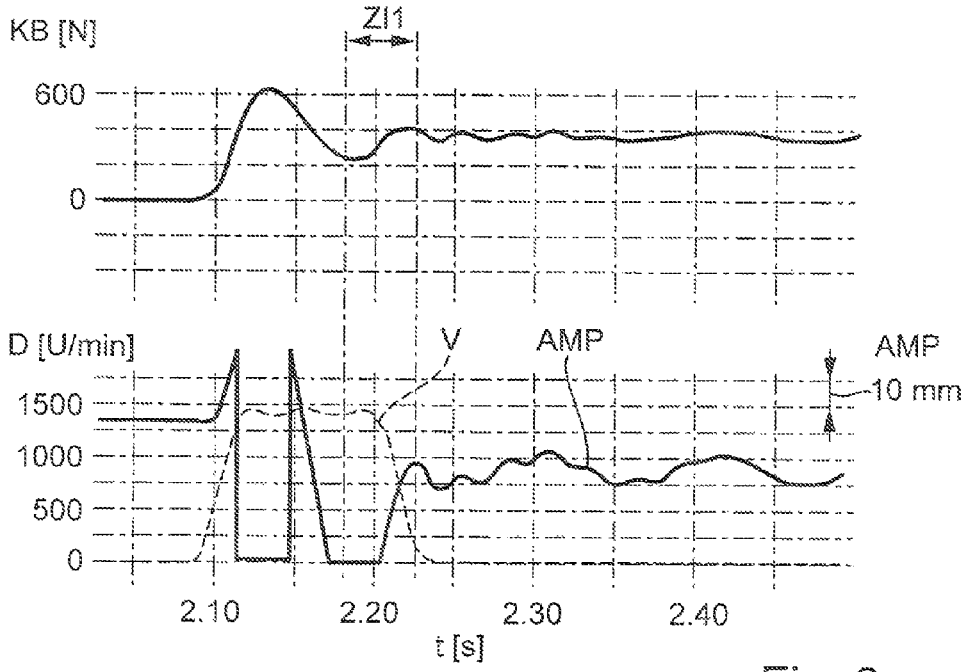
FIG. 8 shows measurement graphs of a second experiment of a bending operation with active damping of the oscillatory movement.

With reference to FIGS. 7 and 8, the results of some bending operations with active damping of the oscillatory movement are explained. In this respect, FIG. 7 shows a measurement graph which, in a joint illustration, shows the bending angle Y [°], the bending speed V and the amplitude AMP of the oscillatory movement of the free end portion as a function of the time t (in [s]) plotted on the abscissa. The rotational speed D, proportional to the bending speed, of the servo motor MY of the Y-axis is plotted in [U/min] ([rev/min]) on the ordinate as a measure of the bending speed (angular speed of the rotational movement of the Y-axis). The oscillation amplitude AMP is obtained from the distance of a defined location on the free end portion of the wire with respect to an optical oscillation sensor which operates with a laser and which detects the distance between the laser sensor and the oscillating bent-part portion. In the case of a free length 1=700 mm of the free end portion and a diameter of 6 mm for the wire to be bent, with fixed chucking a eigenfrequency of approximately 8.89 Hz is obtained and, therefore, an oscillation period lasts for approximately 112 ms. A time window of approximately 28 ms therefore remains for damping.

The profile of the bending speed shows first a relatively rectilinear rise in the region around t=2 ms, before the bending speed reaches its maximum value (corresponding to approximately 500 rev/min of the servo motor) at a time t=2.02. This bending speed then remains essentially constant up to the commencement of the first time interval ZI1. It may be gathered from the amplitude profile that initially the wire, upon first contact with the thereafter bending pin (high acceleration), has a high amplitude lying outside the measurement range of the oscillation sensor and thereafter oscillates with an essentially constant amplitude (approximately 23 mm in the region of the measurement location). The maximum deflections at approximately t=2.09 s, t=2.20 s and t=2.32 s correspond in each case to the maximum deflections in the forward direction, that is to say in the direction of movement of the bending pin. Immediately after the third maximum deflection in the forward direction is reached at approximately t=2.32 s, the rotational speed of the servo motor is reduced by the control device to approximately ⅕ of the initial value within a quarter of the oscillation period in the first time interval ZI1 so that the bending pin brakes exactly in the phase in which the free end portion oscillates back in the direction of the bending pin. The speed curve in the first time interval corresponds approximately to a straight line with sine terminations, having a subsequent brief rise in the rotational speed before the latter falls virtually to zero.

The effects of this deceleration of the bending speed on the oscillation amplitude are dramatic. After a quarter of an oscillation period, the amplitude of the wire is reduced from approximately 23.45 mm to approximately 2.15 mm, this corresponding to damping of approximately 90% or to a reduction in the initial amplitude present before damping to less than about 10% of its value. The insignificant residual amplitude after the first time interval (from approximately 2.35 s) does not disturb the subsequent segment of the bending operation, and therefore the wire can be machined further without a steadying time.

In this example, commencement of the first time interval ZI1 defines commencement of the compensation time interval KZI in which the oscillation-reducing compensating movement of the machine axis (bending axis, Y-axis) is carried out. The compensating movement is characterized here by the rapid, drastic fall in the bending speed (movement speed of the Y-axis) by markedly more than about 50% of the about 70% in the first time interval. The first time interval is also designated below as the "damping time interval," since a sharp reduction in the oscillation amplitude occurs here on account of oscillation energy removal.

In the example of FIG. 7, damping is initiated only in the third oscillation period after application. To achieve damping even in the first period, when boundary conditions are otherwise the same, higher advances or motor rotational speeds would be necessary in the example. At the same time, however, braking should take place, as before, in a very narrow time window, to be precise in a quarter of the period duration. This means that the fall in rotational speed in the damping time interval should be substantially steeper than in the example of FIG. 7. This was achieved in tests, in control terms, in that the fall in rotational speed in the damping time interval, that is to say the reduction in the bending speed, corresponds essentially to a $\sin^2$ acceleration which can be generated relatively simply within the framework of control. In addition to the continuous curve profile of the $\sin^2$ acceleration, simple handling on a CNC controller also constitutes an advantage, since CNC programmes with sin acceleration may consist merely of an NC data record which contains the parameters for sin acceleration in addition to the advance and path particulars.

FIG. 8 shows the measurement log in a similar test arrangement to that on which the measurement log of FIG. 7 was based. The difference is that damping took place even during the first period of the bent-part oscillation, and that, in the first time interval ZI1, braking of the bending-pin movement (Y-axis) corresponding to a $\sin^2$ acceleration was generated by a control device. FIG. 8A shows the bending force KB [N], detected on the bending pin by a force sensor, as a function of time t. Since this is oscillation with a high oscillation fraction in the bending plane, this force signal is proportional to the amplitude of the oscillation and represents exactly both the phase position and the frequency of the oscillation. FIG. 8B shows the curve for the oscillation amplitude AMP and the bending speed V, which is proportional to the rotational speed D of the servo motor MY assigned to the Y-axis. The servo motor first accelerates from a standstill, in the period of time between approximately t=2.07 s and t=2.12 s, to the maximum value according to a $\sin^2$ acceleration and thereafter remains with insignificant fluctuations in the region of the maximum value up to a time point within the first time interval ZI1 at approximately t=2.19 s. Thereafter, the rotational speed of the servo motor of the Y-axis is run down almost to zero within a quarter of an oscillation period according to a $\sin^2$ acceleration. This braking movement is codirectional with the reverse oscillation of the bent part and causes a pronounced damping of the oscillatory movement which, after the conclusion of the first time interval ZI1, has only a low residual amplitude which does not disturb the rest of the bending operation any further. In the example, the amplitude after damping lies at approximately 5.45 mm, this being a very good value in light of the very short bending time of only approximately 150 ms.

The examples from FIGS. 7 and 8 serve essentially for illustrating the possibilities of active damping. Whether very high damping, as is shown by way of example in FIG. 8, is necessary and expedient in an individual case must be decided when the bending process is being designed. In this case, account must be taken, inter alia, of the fact that very high dampings, just like very high accelerations, may lead in individual cases to the plastic deformation of a bent part, which typically should be avoided. The braking of the bending pin may also take place essentially according to a linear law of time.

Figure 9:
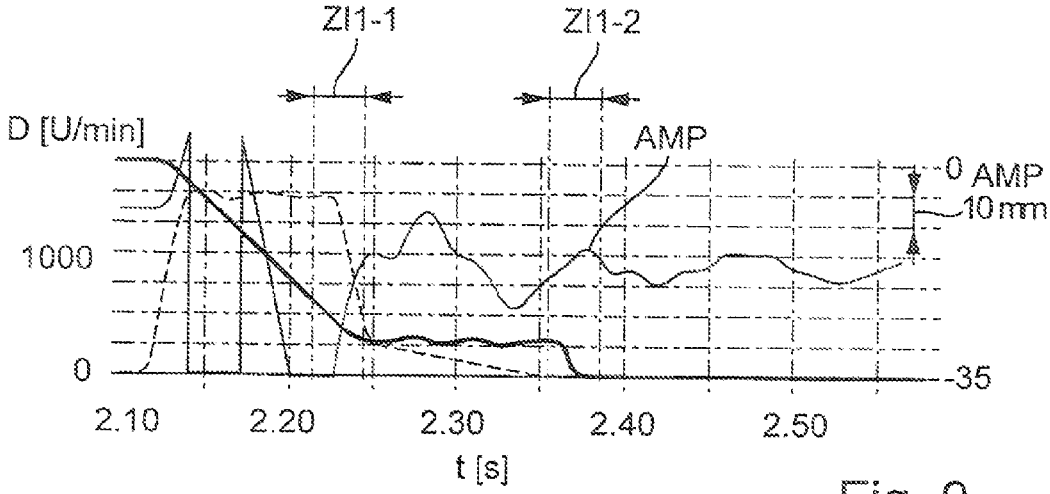
FIG. 9 shows a measurement log of an experiment with twofold damping.

FIGS. 7 and 8 show the damping effect in once-only use. It is also possible, during a bending operation, to damp in a plurality of time-offset time intervals. In this respect, FIG. 9 shows by way of example the measurement log of a test with twofold, time-offset damping, in each first time interval the rotational speed of the servo motor being reduced according to a $\sin^2$ acceleration. In this test, an earlier first time interval ZI1-1 lies between approximately t=2.22 s and t=2.25 s and serves for damping the initially very high amplitude to values of around approximately 15 mm. The rotational speed of the motor is not reduced to zero, but, instead, to a finite value, for example, about 10% to 20% of the value before braking After a further oscillation period, further damping according to a $\sin^2$ acceleration is then carried out in a later first time interval ZI1-2 in the time interval between approximately t=2.36 and t=2.38 s, with the result that the amplitude is further reduced. Where appropriate, lower residual amplitudes can be achieved by multiple damping than in the case of once-only damping.

For effective damping, it is essential that acceleration or deceleration of the relevant machine axis which leads to damping is initiated at the correct time point so that the damping time interval lies optimally with respect to the phase of the oscillatory movement. There are several possibilities for adapting the time position of the damping time interval to the oscillation of the bent part. The correct time point may, for example, be determined experimentally, in that, first, some reference bent parts of a series are bent and, with these bent parts, the phase positions of the oscillations occurring and therefore also time positions of favourable time points for the commencement of compensating movements are determined. The values can then be entered in the control. It is also possible to determine the oscillation behaviour of a bent part for all the phases of the bending process beforehand by simulation, for example, with the aid of the finite element method (FEM), and to predefine the commencement of the compensating time interval and/or other control parameters useful for oscillation compensation according to the result of this simulation. It is also possible to individually fix the compensating counter-movements in terms of frequency and movement profile by eigenfrequencies determined arithmetically by the machine software and other boundary conditions, such as support, friction and orientation for each movement of a machine axis.

In the bending machine as explained with regard to FIG. 2, vibration compensation regulation is implemented which, during the bending operation, detects the oscillatory movements of the workpiece with the aid of at least one oscillation sensor, determines at least the phase position and the frequency of the oscillation from signals of the oscillation sensor and feeds them back to the control device in such a way that the latter controls the corresponding drives of the machine axes pertinent to the oscillation-critical movements, such that the accelerations or decelerations required for the damping action and/or for oscillation suppression are initiated or generated at the correct time point with respect to the current oscillation.

For this purpose, an oscillation sensor 170 is coupled to the bending pin 138 and takes the form of a force sensor which detects the bending forces currently occurring on the bending pin and generates a signal proportional to the bending force and which can be transmitted to the control device 160 and processed by the latter to control the drive MY for the Y-axis.

The feed unit 110 is assigned an oscillation sensor 180 which is likewise designed as a force sensor. By the oscillation sensor 180, on the one hand, the forces parallel to the workpiece axis which occur in the feed unit can be detected and, likewise, those forces or torque which act in the direction of a rotation of the feed unit about the workpiece axis. These forces or torque may occur, for example, when the chucked bent part has a substantial fraction of torsional oscillations such as may occur, for example, when the workpiece already bent once or more than once is rotated to change the bending plane. The signals of the torque sensor are transmitted to the control device 150 and can be processed by the latter for the activation of the drive, responsible for workpiece rotation, of the A-axis (A-motor) with the aid of directed changes in rotational speed, to damp or compensate for a torsional oscillation by a compensating movement. Similarly, the forces acting in the longitudinal direction of the workpiece can be detected, and a signal proportional to this can be transmitted to the control device in the form of an oscillation signal and processed by the latter for the activation of the motor MC responsible for the movement of the C-axis.

Since at least the phase and the frequency of oscillations or oscillation components of the structural part can be determined in real time via the oscillation sensors, compensation regulation can also be carried out, in which the control device 150 controls the time position of the commencement of a compensation time interval of the respective machine axis with the aid of an oscillation signal. For example, the damping movements of the bending axis (Y-axis) which are explained with reference to FIGS. 6 to 8 can be controlled on the basis of signals of the oscillation sensor 170 which detects the bending force on the bending pin.

It is also possible to design the oscillation compensation regulation such that, where appropriate, regulation to as constant a bending force as possible is carried out over a large number of oscillation periods, this being equivalent to minimizing the acceleration difference, as explained in connection with FIG. 6. In this case, account must be taken of the fact that phases of the compulsory force change during acceleration and deceleration are excepted from constant force regulation, and that, in general, there is a dependence on the bending angle and on the bending method.

The possibilities described for damping a bent-part oscillation may be understood as effect-limiting measures which subtract energy from an already excited oscillation and thereby damp the oscillation. Additional dampings may also be introduced, for example, by mounting damping elements (for example, a bending table) and/or by bending in a denser medium. A further effect-limiting measure is to counteract the oscillations of the bent part in a directed manner. The basic idea in this case is to superpose in phase upon the law of motion of a machine axis, for example, the bending axis (Y-axis), a small, more or less sinusoidal movement function which counteracts the prevailing oscillation of the bent part. In this example, too, the drive motor of the corresponding machine axis is the counter-controlling element which is activated via the control device on the basis of the NC program.

Figure 10:
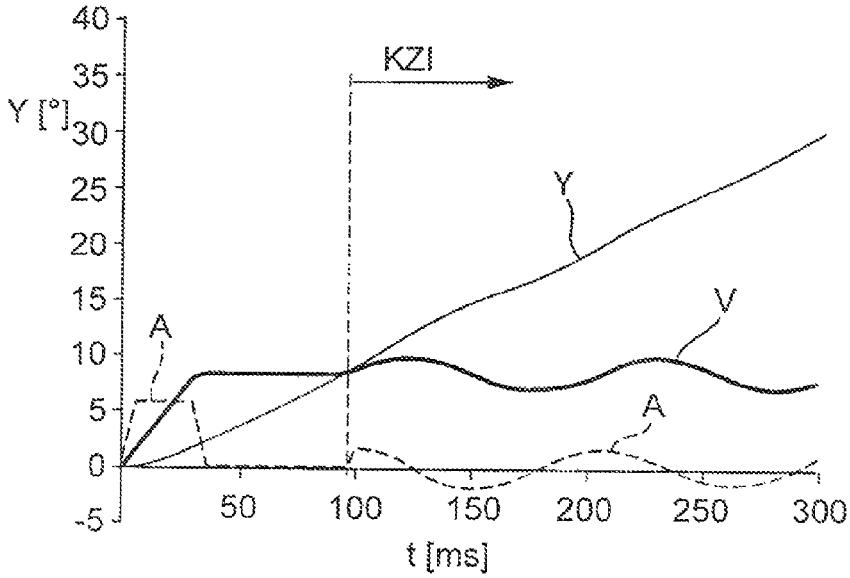
FIG. 10 shows a measurement log of a bending operation in which the uniform main movement of the bending axis has superposed on it a small essentially sinusoidal compensating movement which counteracts the oscillation of the bent party.
Figure 11:
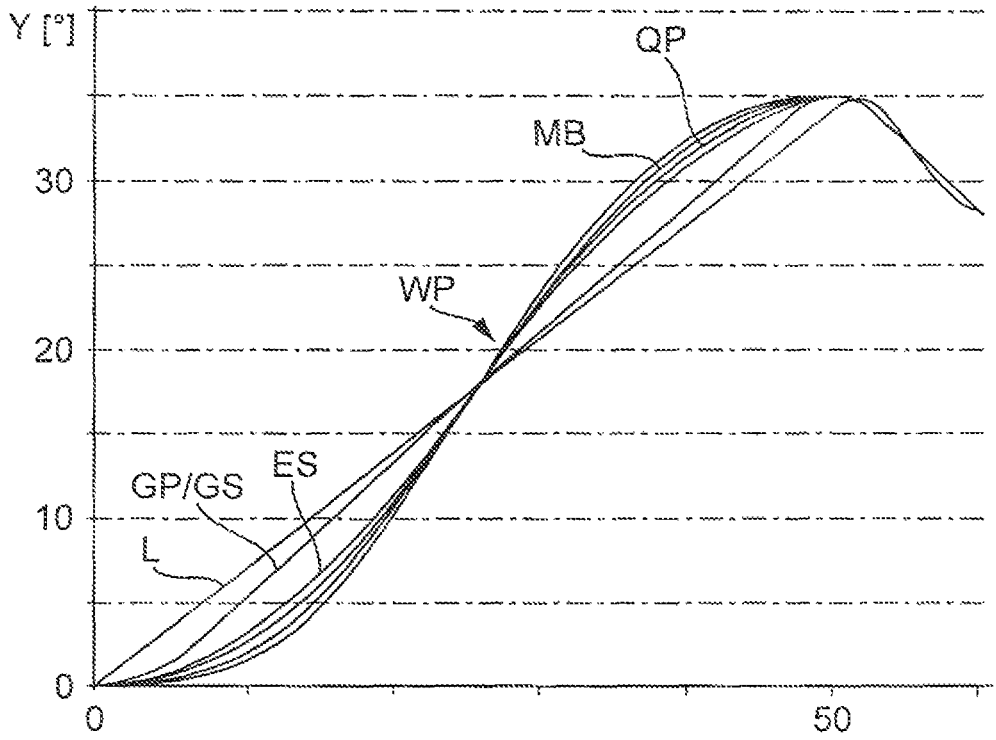
FIG. 11 shows a comparative overview of the path functions of various laws of motion of the bending pin during a bending operation.

Such an example is illustrated qualitatively in FIG. 10. The essentially linear path function Y (bending angle) of the Y-axis (bending axis) commences with a sine termination and then merges into a phase with a uniform bending speed V. After a constant-travel time interval, which runs, for example, from t=30 ms to t=95 ms, a compensation time interval KZI follows, in which the movement speed V is modulated periodically according to a superposed sine function by the amount of a few percentage points of the absolute value of the bending speed. In the path function Y, this superposition of a sine function is manifested by slight periodic deviations from the rectilinear profile. In the speed function V, superposition causes a sinusoidal fluctuation in the speed around the speed value prevailing during the constant-travel phase. It may be gathered from the curve A for the acceleration of the bending tool that the compensation time interval first commences with a positive acceleration (speed increase), this being followed by a plurality of changes between phases of negative acceleration and phases of positive acceleration. The phase position of the sinusoidal movement of the bending pin in relation to the phase position of the oscillation of the workpiece is selected such that these cancel one another and therefore the oscillation of the workpiece is mollified or eliminated. Preferably, the counter-oscillation has a decreasing amplitude to avoid a situation where new characteristic oscillations are excited by the counter-oscillation.

This superposition of laws of motion may be introduced either directly via the servo motor MY for the Y-axis or else by an additional drive, for example, by a piezo-actuator which generates the sinusoidal changing compensating movement of the bending pin independently of the movement of the bending axis generated by the motor of the Y-axis. The bending movement by the drive motor would thereby be decoupled from the oscillation-damping movement generated by the piezo-actuator. The piezo-actuator would have to be considered as part of the drive for the movement of the Y-axis. The drive for the movement is then composed of a coarse drive (servo motor) and a highly dynamic fine drive (piezo-actuator), which act in combination.

In many instances, alternatively or additionally, cause-limiting measures are provided, that is to say those measures which are suitable for avoiding excessive oscillation excitation from the outset. Preferably, in this case, there is provision whereby a movement profile of an oscillation-relevant movement, for example, the rotational movement of the bending pin during bending, obeys, between a starting point and end point of the movement, a law of motion which corresponds to a mathematically smooth function. This may mean, in particular, that both the speed profile of the entire movement and the acceleration profile of the entire movement are free of salient points or corner points, and therefore these functions can be differentiated continuously.

In the practical implementation of this approach, inter alia, various standardized laws of motion were investigated, such as are listed, for example, in VDI Directive 2143 Sheet 1, entitled "Bewegungsgesetze für Kurvenbetriebe" ["Laws of motion for curved operations"], the subject matter of which is incorporated herein by reference. The content of this VDI Directive to that extent therefore becomes the content of this description by reference. For test series, a wire with a diameter of 6 mm and with a free length of 700 mm was bent through a bending angle of 35° in a bending time of 330 ms, straightening having been ruled out by the bending pin coming to bear against the wire with a prestress of 2° as disturbance variable. The size of the oscillation amplitude before a first location with a high change in acceleration is reached was selected as a criterion for the extent of oscillation excitation in the comparison of the laws of motion with one another. FIG. 10 shows a comparative overview of the path function of various laws of motion used, the number of supporting points which is proportional to the bending time being plotted on the abscissa, and the bending angle Y [°] being plotted on the ordinate. A linear movement profile (curve L), a straight line with parabola terminations (curve GP) and a straight line with inclined sine terminations (curve GS) are illustrated as reference profiles which represent conventional movement profiles. These have in each case long segments with a constant speed (rectilinear path function) in which the acceleration assumes the value zero.

In the other movement profiles illustrated, the movement speed and acceleration change continuously between the starting point and end point of the movement illustrated, the speed function reaching a maximum value between the starting point and end point, and the acceleration function running between the starting point and end point through a zero passage from positive to negative accelerations. In the example, a turning point WP of the path function (speed maximum) lies approximately centrally between the initial angle (0°) and final angle) (35°). The acceleration profile is gently rounded with a very shallow slope at commencement of the movement with speed increases markedly lower in the initial phase (going from the starting point) than along the straight line (L) and also lower than along the straight line with sine termination.

These mathematically smooth movement profiles include: the fifth degree polynomial, the quadratic parabola (curve QP), the modified acceleration trapezium (curve MB), the simple sinuid (curve ES), the modified sinuid, the harmonic movement sequence, the prolate fifth-degree polynomial, the prolate inclined sinuid and the low-noise cosine combination. FIG. 10 shows that the path functions of these laws of motion differ from one another only minimally and, therefore, only a few of the smooth curves are designated explicitly.

It was shown in various tests, that above all, a movement profile corresponding to a modified acceleration trapezium (curve MB) and the movement profile corresponding to a quadratic parabola (curve QP) generated very low oscillation amplitudes which lay by a multiple below those oscillation amplitudes which arose during conventional movements corresponding to the straight line with inclined sine terminations (curve GS) or to the straight line with parabola terminations (curve GP). Whereas, in a test series, the latter lay, for example, with amplitudes of more than 40 mm, outside the measurement range of laser-assisted amplitude measurement, amplitude values of below 15 mm, as a rule even of approximately 10 mm or less, were obtained generally for the smooth movement profiles.

To assess the capability of various laws of motion in terms of the avoidance of oscillations during wire bending or tube bending, above all two comparative values are to be considered, to be precise the acceleration characteristic value ($C_a$) and the jolt characteristic value ($C_j$). The acceleration characteristic value is the maximum value of the second derivative of the standardized law of motion. By contrast, the jolt characteristic value embodies the maximum value of the third derivative of the standardized law of motion. The jolt characteristic value is therefore obtained by deriving the acceleration in terms of time. Table A shows the $C_a$ and $C_j$ values of some laws of motion used in the tests.

TABLE A

| Law of Motion | $C_a$ | $C_j$ | jolt-free |
|---|---|---|---|
| Simple sinuid | 4.93 | ∞ | No |
| $5^{th}$-degree polynomial | 5.78 | 60 | Yes |

TABLE A-continued

| Law of Motion | $C_a$ | $C_j$ | jolt-free |
|---|---|---|---|
| Quadratic parabola | 4 | ∞ | No |
| Mod. acceleration trapezium | 4.89 | 61.4 | Yes |
| Mod. Sinuid | 5.53 | 69.5 | Yes |
| Inclined sinuid | 6.28 | 39.5 | Yes |

The tests showed that the laws of motion with low standardized acceleration ($C_a$ value) generated very low oscillation amplitudes. These are, the modified acceleration trapezium (curve MB) and the quadratic parabola (curve QP). The good cut-off of the parabola also shows that the standardized jolt function ($C_j$ value) plays a subordinate role, as compared with the acceleration characteristic value. The significance of the standardized acceleration value for oscillation avoidance illustrates that the mass inertia and the associated accelerations are decisively responsible for the whiplash effect, and that the generation of oscillations can be partially suppressed if only relatively low accelerations are generated by the corresponding machine axis over the entire movement between the starting point and end point.

Essential aspects have been explained here on the basis of selected representative examples from the wire-bending sector since problematic oscillation generation, which is often also designated as the "whiplash effect," is manifested to a substantially greater extent in wire-bending than in tube-bending. This is due to the fact that, in a comparison of the mass of a tube with the mass of a wire, the outside diameter and the density being the same, the tube possesses an appreciable weight advantage and therefore substantially lower mass inertia, meaning that the inertia forces acting during the same accelerations are also correspondingly lower. Nevertheless, in tube-bending, problems may occur on account of workpiece oscillations. The approaches to a solution which are explained by the example of wire-bending can basically also be employed in a similar way in tube-bending or in the bending of other elongate workpieces.

Oscillation compensation may be used both in the case of the machine axes employed for the positioning operations and orientation operations and in the case of the machine axes (bending axes) active during the bending operation. Use is possible on single-head machines, double-head or multi-head machines and also on multi-station machines with a rotating bending head or rotating workpiece. Additional measures which, for example, limit the degrees of freedom of oscillations (for example, table plates) or which damp an oscillation may be provided. Thus, for example, holders, supports or grippers may be provided, which guide the bent workpiece and thus prevent the formation of oscillations.

The above description has been given by way of selected representative examples. From the disclosure given, those skilled in the art will not only understand our methods and apparatus and their attendant advantages, but will also find apparent various changes and modifications to the structures and methods disclosed. It is sought, therefore, to cover all changes and modifications as fall within the spirit and scope of this disclosure, as defined by the appended claims, and equivalents thereof.

What is claimed is:

1. A method of producing a bent part by two- or three-dimensional bending of an elongate workpiece in a bending process comprising:

activating and coordinating movements of driven machine axes of a bending machine numerically controlled by a control device;

moving at least one portion of a workpiece into an initial position in a region of engagement of a bending tool by one or more feed operations; and forming a portion of the workpiece by bending in at least one bending operation;

wherein 1) the movements of the machine axes are generated according to a movement profile predetermined by the control device of the bending machine, 2) the movements of the machine axes comprise at least one oscillation-relevant movement leading to an oscillation of a free end portion of the bent part, and 3) during the oscillation-relevant movement, a compensating movement is generated in at least one compensation time interval, the compensating movement being effective to at least one of i) reduce a generation of oscillations and ii) subtract oscillation energy from the oscillating free end portion.

2. The method according to claim 1, wherein a machine axis active during an oscillation-relevant movement is controlled such that positive or negative acceleration is generated upon commencement of the compensation time interval to bring about a reduction in a speed difference between an instantaneous movement speed of the machine axis and a corresponding instantaneous movement speed of the oscillating free end portion of the workpiece as compared to a speed difference without the compensating movement.

3. The method according to claim 2, wherein the machine axis active during the oscillation-relevant movement is controlled such that the commencement of the compensation time interval lies within a first time interval between a time point of maximum deflection of an oscillatory movement and an immediately following time point of maximum oscillation speed with respect to a time profile of the oscillatory movement.

4. The method according to claim 3, wherein the maximum deflection is a maximum deflection in a forward direction of movement of the machine axis, and the compensating movement of the machine axis commences with a phase of negative acceleration.

5. The method according to claim 4, wherein the compensating movement with negative acceleration commences temporally before an end point of the movement is reached such that after the negative acceleration, the machine axis is urged directly towards the end point without further substantial positive acceleration.

6. The method according to claim 3, wherein the maximum deflection is a maximum deflection in a reverse direction of movement of the machine axis, and the compensating movement of the machine axis commences with a phase of positive acceleration.

7. The method according to claim 6, wherein the compensating movement with positive acceleration takes place in a movement phase of the machine axis in which the movement of the machine axis becomes faster.

8. The method according to claim 1, wherein the machine axis performing the oscillation-relevant movement is a rotational axis for a rotational movement of part of the bending tool.

9. The method according to claim 8, wherein a bending speed of the bending tool is reduced by at least about 50% in a first time interval between a time point of maximum deflection of an oscillatory movement and an immediately following time point of maximum oscillation speed with respect to a time profile of the oscillatory movement.

10. The method according to claim 1, further comprising:

calculating eigenfrequency data from geometry data of the bending process and workpiece data, wherein the eigenfrequency data represent one or more eigenfrequencies of the oscillating free end portion of the workpiece for one or more successive phases of the bending process.

11. The method according to claim 10, wherein a time position of a commencement of the compensation time interval is controlled using the eigenfrequency data and data on the phase position of the oscillation at a temporally earlier defined reference time point.

12. The method according to claim 11, wherein a reference time point is a time point of a commencement of an acceleration movement after a resting point of the movement of the machine axis.

13. The method according to claim 12, wherein the reference time point is the commencement of the acceleration movement of a bending pin after the bending pin has been applied to the workpiece.

14. The method according to claim 1, further comprising:

detecting a time profile of the oscillation of the free end portion by at least one oscillation detection system which comprises at least one oscillation sensor which generates an oscillation signal representing at least a phase position and a frequency of the oscillation of the free end portion.

15. The method according to claim 14, wherein the control device processes the oscillation signal for controlling the movement profile of the machine axis executing the compensating movement.

16. The method according to claim 15, wherein the control device processes the oscillation signal such that the control device controls a time position of the commencement of a compensation time interval by the oscillation signal.

17. The method according to claim 1, wherein the compensation movement is generated which includes at least one change between a phase with negative acceleration, a subsequent phase with positive acceleration and a subsequent phase with negative acceleration in the compensation time interval, the phases merging one without an abrupt change between speed increase and speed reduction.

18. The method according to claim 17, wherein the compensation movement is generated to produce, in the compensation time interval, an approximately sinusoidal profile of the movement speed with a multiple change between positive and negative acceleration, and with decreasing amplitude.

19. The method according to claim 1, wherein a machine axis active during an oscillation-relevant movement is controlled such that a movement profile of the oscillation-relevant movement obeys, between a starting point and end point of the movement, a law of motion which corresponds to a mathematically smooth function so that no abrupt changes occur for movement speed and movement acceleration.

20. The method according to claim 19, wherein both the movement speed and movement acceleration vary continuously during entire oscillation-controlled movement.

21. The method according to claim 19, wherein the movement speed reaches a maximum value between the starting point and the end point, and the movement acceleration runs, between a starting point and an end point through a zero passage from positive to negative accelerations.

22. The method according to claim 1, wherein a wire or a tube is bent by the bending process.

23. A non-transitory computer-readable medium for providing instructions for a bending machine carrying out the method according to claim 1 when loaded in a memory of a computer of the bending machine.

* * * * *